US005113627A

United States Patent [19]

Jarrett, Sr.

[11] Patent Number: 5,113,627

[45] Date of Patent: May 19, 1992

[54] SIGN AND ANCHOR APPARATUS

[76] Inventor: Robert L. Jarrett, Sr., 930 Stafford Dr. NW, Christiansburg, Va. 24073

[21] Appl. No.: 657,414

[22] Filed: Feb. 19, 1991

[51] Int. Cl.[5] ..... E02D 5/74

[52] U.S. Cl. ..... 52/157; 248/156; 248/545; 248/552

[58] Field of Search ..... 52/156, 157, 160, 161, 52/165; 248/156, 552, 545, 553

[56] References Cited

U.S. PATENT DOCUMENTS

| | | | |
|---|---|---|---|
| 1,736,177 | 11/1929 | Snook | 52/157 |
| 2,529,432 | 11/1950 | Tenner | 248/552 |
| 3,848,367 | 11/1974 | Barnes | 52/157 |
| 4,191,034 | 3/1980 | Froess et al. | 248/552 |
| 4,389,034 | 6/1983 | Suttles | 52/165 X |
| 4,593,872 | 6/1986 | Svenson | 52/157 X |
| 4,778,142 | 10/1988 | Roba | 52/157 X |
| 4,803,812 | 2/1989 | Alexander, Sr. | 52/157 |
| 4,863,137 | 9/1989 | Cockman et al. | 52/157 X |
| 4,910,902 | 3/1990 | Anderson | 248/545 X |
| 4,923,165 | 5/1990 | Cockman | 52/157 X |
| 5,011,107 | 4/1991 | Reece | 52/157 X |
| 45,024,551 | 6/1991 | Hinterholzer | 52/165 X |
| 5,042,183 | 8/1991 | Kennedy | 247/156 X |

FOREIGN PATENT DOCUMENTS

| | | | |
|---|---|---|---|
| 1504025 | 10/1967 | France | 52/157 |
| 337212 | 2/1936 | Italy | 248/156 |
| 798426 | 7/1958 | United Kingdom | 52/157 |
| 1173603 | 12/1969 | United Kingdom | 248/552 |

*Primary Examiner*—David A. Scherbel
*Assistant Examiner*—Kien Nguyen
*Attorney, Agent, or Firm*—Leon Gilden

[57] ABSTRACT

A sign member including a sign frmaework, including a lower and upper bridge member, wherein the lower bridge member includes an aperture directed therethrough. An anchor member is securable to the lower bridge member and includes a central shaft with a screw flight formed thereabout to direct the central shaft into a ground soil support position, with the upper terminal end of the central shaft including a framework and a framework including a plate mounted therewithin, wherein the plate includes a plate aperture cooperative with the lower bridge plate aperture to secure the anchor member to the side preventing tapering, removal, and loss of the sign member.

3 Claims, 4 Drawing Sheets

PRIOR ART

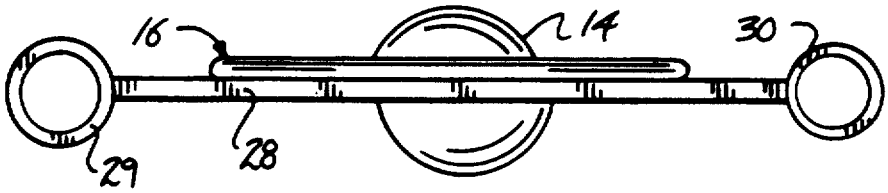
FIG 7
FIG 8
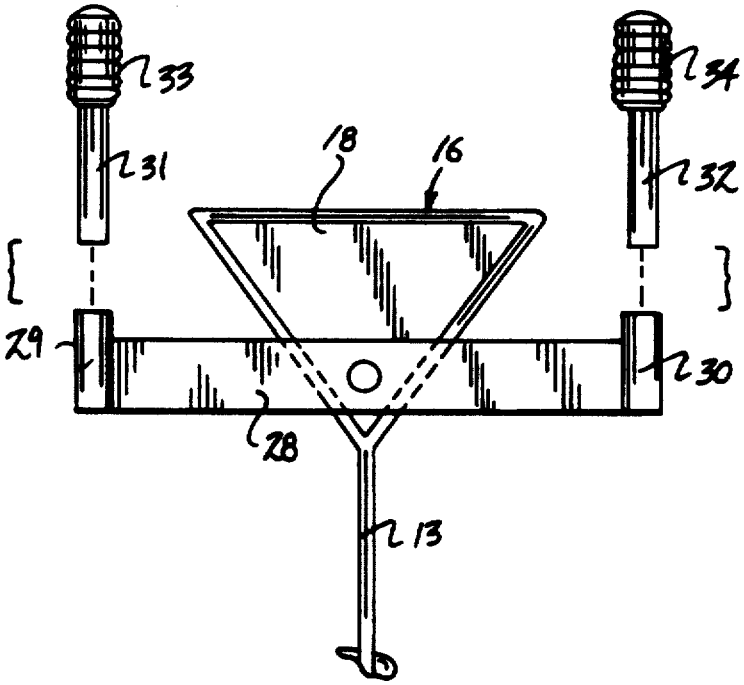

SIGN AND ANCHOR APPARATUS

BACKGROUND OF THE INVENTION

1. Field of the Invention

The field of the invention relates to anchoring structure, and more particularly pertains to a new and improved sign and anchor apparatus wherein the same provides an anchor member cooperative with a sign member to secure the sign member to underlying soil.

2. Description of the Prior Art

The use of signs, and particularly in real estate signs that are removable mounted within surrounding soil relative to a dwelling or property to be advertised, the signs are frequently the objects of vandalism, removal, and associated loss. Various anchor-type structure is provided in the prior art, as exemplified in U.S. Pat. No. 4,803,812 to Alexander, Sr. wherein a screw member is directed into underlying soil for mounting a post thereon.

Similarly, U.S. Pat. No. 4,863,137 to Cockman, et al. sets forth a further example of a post anchor utilizing an arbor-type structure directed into the underlying soil, wherein flange members mount a post at the upper terminal end of the arbor structure.

U.S. Pat. No. 4,833,846 to McFeetors, et al. sets forth a ground anchor system for supporting an overlying structure such as a portion of a building framework.

U.S. Pat. No. 4,778,142 to Roba sets forth an anchor member for mounting and positioning a lower portion of an awning structure within an upper eyelet portion of the auger organization.

U.S. Pat. No. 4,593,872 to Svensson sets forth an anchoring device for posts and the like utilizing a sleeve mounted to a shaft, with the shaft mounting thereabout for securement to soil structure.

As such, it may be appreciated that there continues to be a need for a new and improved sign and anchor apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of anchor apparatus now present in the prior art, the present invention provides a sign and anchor apparatus wherein the same selectively secures a sign member relative to the anchor in an interlocked relationship. As such, the general purpose of the present invention, which will be described subsequently in greater detail, is to provide a new and improved sign and anchor apparatus which has all the advantages of the prior art anchor apparatus and none of the disadvantages.

To attain this, the present invention provides a sign member including a sign framework, including a lower and upper bridge member, wherein the lower bridge member includes an aperture directed therethrough. An anchor member is securable to the lower bridge member and includes a central shaft with a screw flight formed thereabout to direct the central shaft into a ground soil support position, with the upper terminal end of the central shaft including a framework and a framework including a plate mounted therewithin, wherein the plate includes a plate aperture cooperative with the lower bridge plate aperture of secure the anchor member to the side preventing tampering, removal, and loss of the sign member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familar with patent or legal terms or phraseology, to determine quickly from a cursory inspection the nature and essence of the technical dislosure of the application. The abstract is neither intended to define the invention of the application, which is measured by the claims, nor is it intended to be limiting as to the scope of the invention in any way.

It is therefore an object of the present invention to provide a new and improved sign and anchor apparatus which has all the advantages of the prior art anchor apparatus and none of the disadvantages.

It is another object of the present invention to provide a new and improved sugn and anchor apparatus which may be easily and efficiently manufactured and marketed.

It is further object of the present invention to provide a new and improved sign and anchor apparatus which is of a durable and reliable construction.

An even further object of the present invention is to provide a new and improved sign and anchor apparatus which is susceptible of a low cost of manufacture with regard to both materials and labor, and which accordingly is then susceptible of low prices of sale to the consuming public, thereby making such sign and anchor apparatus economically available to the buying public.

Still yet another object of the present invention is to provide a new and improved sign and anchor apparatus which provides in the apparatuses and methods of the prior art some of the advantages thereof, while simultaneously overcoming some of the disadvantages normally associated therewith.

Still another object of the present invention is to provide a new and improved sign and anchor apparatus wherein the same permits ease of mounting of the anchor structure with an underlying soil structure to permit subsequent locking of a sign assembly relative to the anchor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic top view of the modified anchor member.

FIG. 8 is an orthographic side view of the modified anchor member utilizing associated rotating rods positionable within opposed tubes of the modified anchor member.

DESCRIPTION OF THE PREFERRED EMBODIMENT

Figure 1:
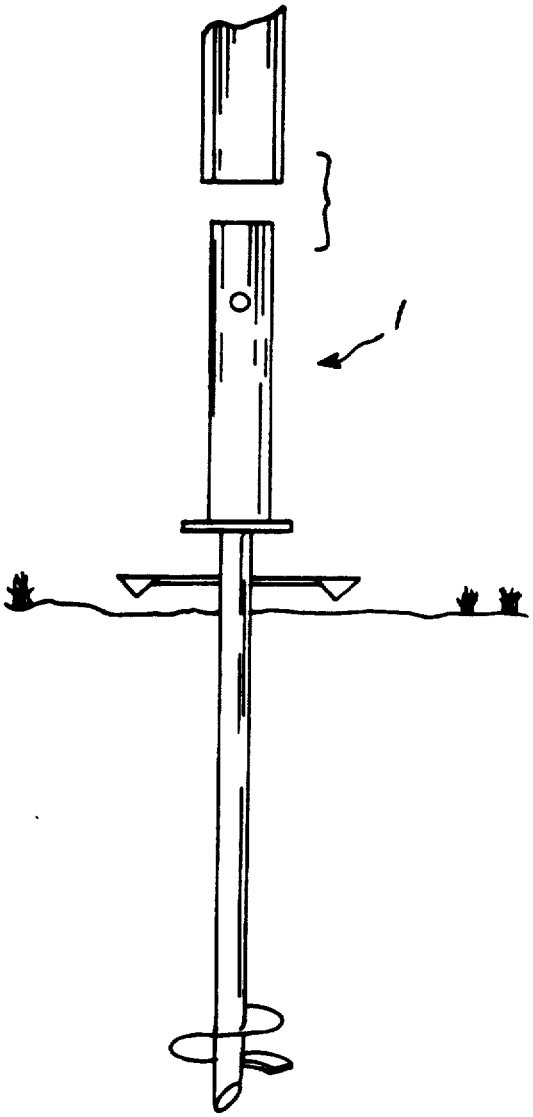
FIG. 1 is an orthographic side view, taken in elevation, of a prior art post anchor structure.
Figure 2:
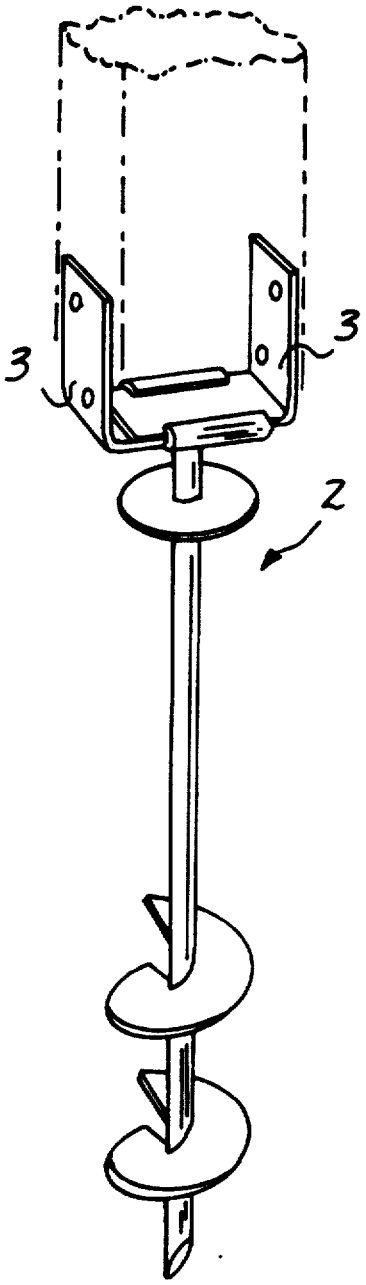
PRIOR ART Fig 2
FIG. 2 is an isometric illustration of a further example of a post anchor type structure.
Figure 3:
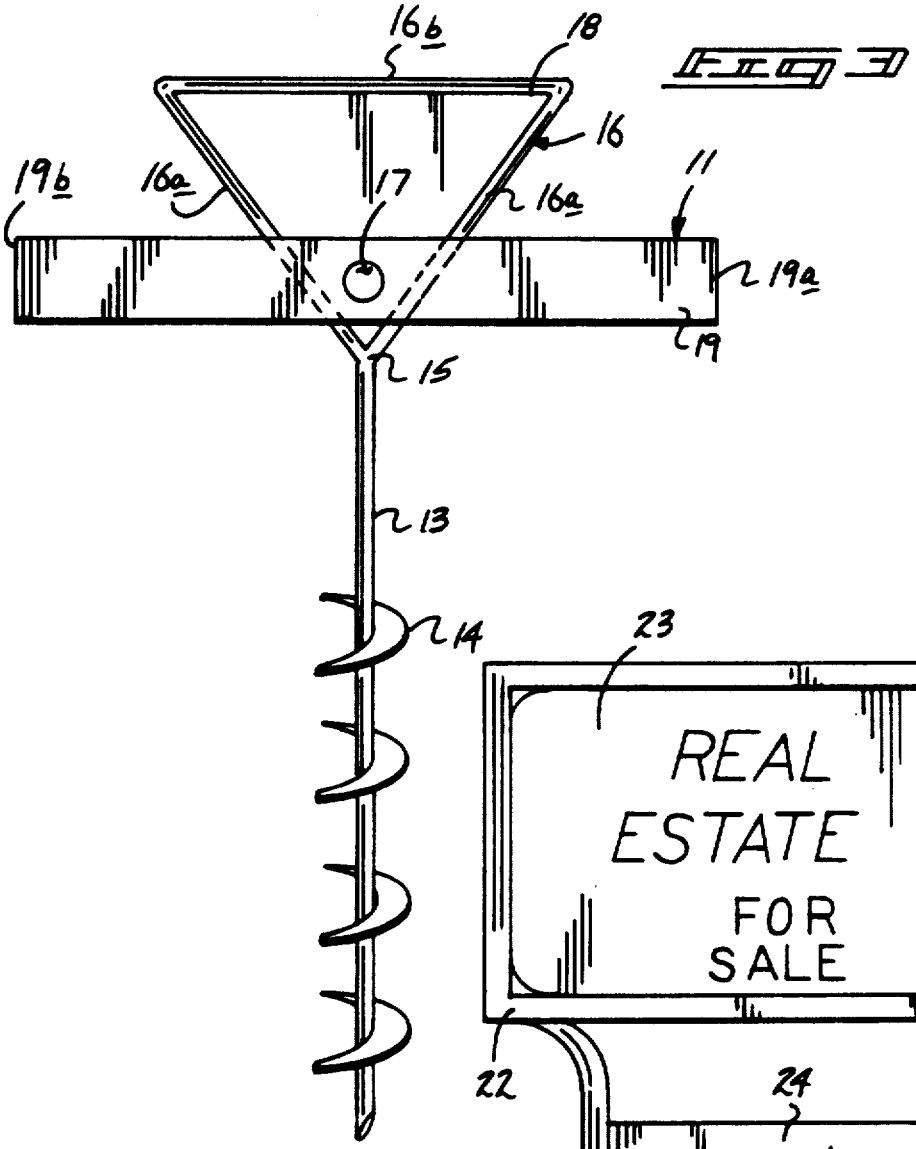
FIG. 3 is an orthgraphic side view, taken in elevation, of the anchor member utilized by the instant invention.
Figure 4:
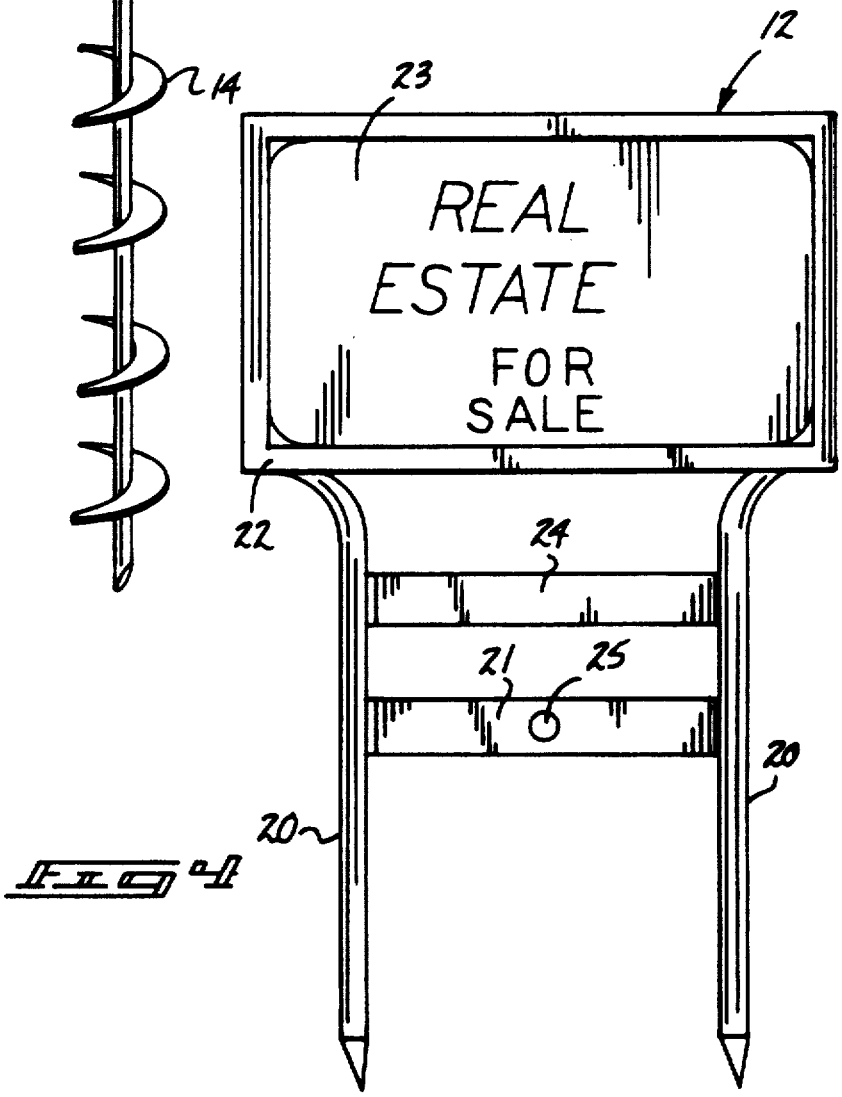
FIG. 4 is an orthographic side view, taken in elevation, of the sign member utilized by the instant invention.

With reference now to the drawings, and in particular to FIGS. 1 to 8 thereof, a new and improved sign and anchor apparatus embodying the principles and concepts of the present invention and generally designated by the reference numeral 10 will be described.

FIG. 1 illustrates a prior art anchor organization 1, as exemplified in U.S. Pat. No. 4,803,812, wherein an auger structure mounts a post to an upper terminal end of the anchor structure. Further, U.S. Pat. No. 4,863,137 is exemplified by FIG. 2 wherein the organization 2 and associated auger structure mounts a plurality of flanges 3 to receive a post therebetween.

Figure 5:
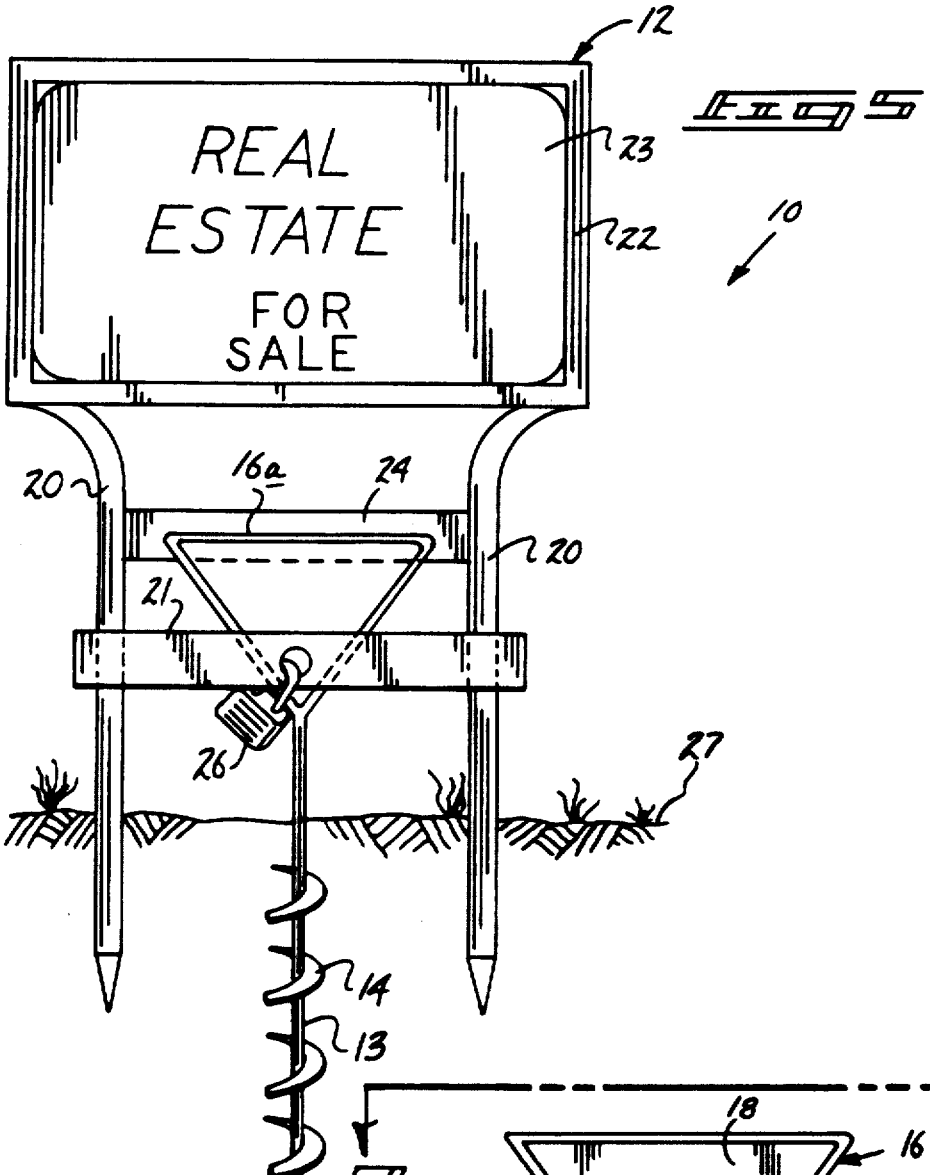
FIG. 5 is an orthographic side view, taken in elevation, of the sign and anchor apparatus in an assembled configuration.

More specifically, the sign and anchor apparatus 10 of the instant invention essentially comprises an elongate anchor member 11 securable to a sign structure 12, as illustrated in FIG. 5. The anchor member includes a central shaft 13 defined by a continuous cross-sectional configuration, with a pointed lower terminal end. A screw flight 14 is turned about a major portion of the central shaft 13 adjacent the lower terminal end. The central shaft 13 includes a central shaft upper terminal end 15 mounting a continuous framework member 16 thereon. The framework member 16 includes spaced lower framework legs **16*a* extending laterally of the upper terminal end 15, with an upper framework leg 16*b* joining the lower leg 16*a* to define the continuous framework. A lock plate 17 is fixedly mounted within the framework 16 coextensive therewith, and including a through-extending lock opening 17 positioned adjacent the central shaft upper terminal end 15. A torque plate 19 is mounted to the framework member 16 orthogonally aligned relative to the shaft 13, with the torque plate 19 extending laterally beyond the framework member 16 defined by a first and second respective terminal end 19*a* and 19*b*. The torque plate 19 permits an enhanced mechanical advantage directed to the shaft 13 to enhance its directing into the ground soil support 27, in a manner as illustrated in FIG. 5**.

The sign 12 includes a plurality of spaced parallel legs 20, including a lower bridge plate 21 orthogonally and fixedly mounted between the spaced legs 20. The spaced legs 20 further fixedly secure a sign framework 22 at upper terminal ends of the spaced legs 20, with a sign plate 23 mounted within the sign framework 22 for various advertising purposes. An upper bridge plate 24 is arranged parallel to and spaced above the lower bridge plate 21. A lower plate opening 25 is directed through the lower bridge plate 21, wherein the spacing between the lower plate opening 25 to the upper bridge plate 24 is substantially equal to or less than the spacing from the upper terminal end 15 of the central shaft to the upper framework leg **16*b*. Alternatively presented, the lower leg 16*a* of the framework 16 extends upwardly to a spacing equal to or beyond the upper bridge plate 24 when the lock opening 17 is coaxially aligned with the lower plate opening 25 to receive a lock member 26 to thereby secure the anchor member 11 to the sign 12. As illustrated in FIG. 5 for example, the positioning of the upper securement plate 16*a* upon or above the upper bridge plate 24 prevents relative rotation of the anchor member 11 relative to the sign 12 when the anchor member and sign are latched together by the lock member 26**.

Figure 6:
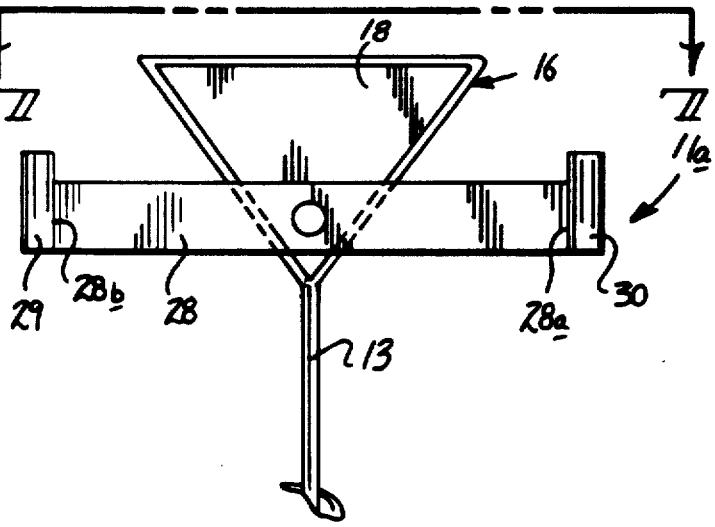
FIG. 6 is an orthographic side view of a modified anchor member.

FIGS. 6–8 illustrate the use of a modified anchor member **11*a*, wherein the modified anchor member 11*a* includes a modified torque plate 28 fixedly mounted to the framework 16 in a manner as set forth relative to the torque plate 19. The modified torque plate 28 includes a respective first and second end 28*a* and 28*b* respectively mounting a first and second tube member 29 and 30 whose effective axes are arranged orthogonally relative to the longitudinally aligned torque plate 28. Each respective first and second tube member 29 and 30 rotatably receive a first and second rod 31 and 32 therewithin, with each rod 31 and 32 mounting a respective first and second rod handle 33 and 34. The rod handles 33 and 34 are of a diameter greater than those defined by the respective first and second tube members 29 and 30 to permit manual grasping of the first and second rod handles 33 and 34 to permit ease of rotation of the modified torque plate and the associated central shaft 13 to direct the central shaft into the ground swivel support 27**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sign and anchor apparatus comprising, in combination, an anchor member in operative securement with a sign member, and a lock member to selectively secure the anchor member and sign member together, wherein the anchor member includes a central shaft, with the central shaft including a screw flight mounted adjacent to a lower terminal end of the central shaft, with the central shaft including an upper terminal end, and a framework member mounted fixedly to the central shaft upper terminal end, and a plate mounted within the framework member, and a lock opening directed through the plate, and the sign member including a plurality of spaced legs including a lower bridge plate mounted orthogonally and fixedly between the spaced legs, each of said spaced legs including a ground penetrating lower pointed end, and the lower bridge plate including a lower bridge plate opening, with the lower bridge plate opening selectively aligned with the lock opening of the plate, and the lock member selectively mounted to the lock opening and the lower plate opening to secure the anchor member and sign member together.

2. An apparatus as set forth in claim 1 wherein the framework member is defined by a continuous framework, including spaced lower legs extending laterally and upwardly of the central shaft upper terminal end, and the framework further including an upper framework leg joining the lower legs together, and the sign member including an upper bridge plate spaced above the lower bridge plate a predetermined spacing, wherein a further spacing defined between the lower plate opening and the upper bridge plate is substantially equal to or less than a spacing from the lock opening to the upper framework leg.

3. An apparatus as set forth in claim 2 further including a torque plate fixedly mounted to the continuous framework member directed across and fixedly mounted to the lower legs and extending laterally of the lower legs and orthogonally oriented relative to the central shaft, wherein the torque plate includes a respective first and second terminal end.

* * * * *